United States Patent [19]

Wilhite

[11] Patent Number: 4,911,347

[45] Date of Patent: Mar. 27, 1990

[54] CARRIER AND LOCKING SEAL FOR ARTICULATED DRAWING TUBES AND OTHER CYLINDRICAL OBJECTS WITH SLIP ON END CAPS

[76] Inventor: Daniel W. Wilhite, 3413 Ridgeway Ave., Evansville, Ind. 47715

[21] Appl. No.: 250,233

[22] Filed: Sep. 28, 1988

[51] Int. Cl.[4] ..... A45F 3/14

[52] U.S. Cl. ..... 224/257; 224/258; 224/259; 224/264; 224/251; 224/202

[58] Field of Search ..... 224/202, 150, 257, 258, 224/264, 901, 917, 250, 251; 24/3 A, 442, 306, 314; 428/102, 352, 100, 99; 220/352, 356, 315

[56] References Cited

U.S. PATENT DOCUMENTS

| | | | |
|---|---|---|---|
| 1,631,694 | 6/1927 | Rick | 224/264 |
| 2,530,695 | 11/1950 | Helmert | 224/917 |
| 2,812,123 | 11/1957 | Girton | 224/150 |
| 3,144,230 | 8/1964 | Brooks | 224/205 |
| 3,377,007 | 4/1968 | Gayler, Jr. | 224/205 |
| 4,041,562 | 8/1977 | Nealy | 24/3 A |
| 4,558,807 | 12/1985 | Jackson | 224/251 |
| 4,728,123 | 3/1988 | Kassal et al. | 224/220 |

FOREIGN PATENT DOCUMENTS

| | | | |
|---|---|---|---|
| 3128920 | 2/1983 | Fed. Rep. of Germany | 224/257 |
| 767014 | 1/1957 | United Kingdom | 224/246 |

*Primary Examiner*—Linda J. Sholl

[57] ABSTRACT

A strap type carrier and locking seal for articulated drawing tubes and other cylindrical objects with slip on end caps of different diameters and lengths. The carrier consists of two circumferential fastening members and an adjustable longitudinal carrying strap. The circumferential fastening members are cinched about the top and bottom of a tube or cylinder by wrapping the fastening members around the tube and extending the free end of the fastening members through a rectangular ring at the opposite end. The free end is then folded back to engage complimentary hook and loop fastening materials. The circumferential fastening members comprise an elastomer coating on the side facing the cylindrical object to facilitate a secure grip and to effectuate a locking seal for the end caps of articulated drawing tubes. The carrying strap is attached to the dee ring of the top and bottom circumferential fastening members via swivel snaphooks.

2 Claims, 1 Drawing Sheet

CARRIER AND LOCKING SEAL FOR ARTICULATED DRAWING TUBES AND OTHER CYLINDRICAL OBJECTS WITH SLIP ON END CAPS

BACKGROUND

1. Field of the Invention

The present invention relates to a strap type carrier and locking seal for articulated drawing tubes and other cylindrical objects with slip on end caps and other cylindrical objects not having integrally attached carrying straps.

2. Description of Prior Art

Carrying a tube or cylinder by clutching it with a hand or by tucking it under one's arm can be unwieldy and clumbsy. Such is compounded when tubes are large or awkward in size and weight, of slick metal or cardboard, and especially when attempting to carry more than one tube simultaneously; the tubes have tendency to slide, pivot, and rotate in all directions. In addition, articulated tubes with slip on end caps often do not securely contain the tube contents as a result of the cap either slipping off or being hammered off by the shifting and weight of the contents. It is therefore desirable to devise a carrier and locking seal for articulated tubes and other cylindrical objects which will securely seal the end cap on the tube and allow one's hands to be free to carry other items, open doors, and conduct business with finesse and with a professional appearance.

Heretofore, two strap type tube carriers have been proposed and implemented for the use of carrying drawing tubes not having integrally attached carrying straps.

One such strap is manufactured by Pictura Products in Orange, Calif. under the trademark of "Sketch-Pak/dph". It comprises two straps for attachment to the top and bottom of a tube and a shoulder strap. The top and bottom straps are of an elastic material and are fastened to the tube using buckles. In use, regardless how tightly the user attaches the top and bottom elastic straps, the elastic straps stretch excessively and slide up and down the tube. When attached to tubes having slip on end caps, the strap does not seal the cap onto the tube due to excessive stretching and slipping. Consequently, should the tube be inverted, the end cap will slide off spilling the contents of the tube. Users find the strap is difficult and time consuming to attach due to the buckle type fastener. In addition, the shoulder strap is joined to the top and bottom straps in a way which allows for twisting of the strap during application which necessitates removing the strap and reattaching it to the tube. Also, excess elastic material dangling from the buckles of the top and bottom straps appears sloven and crude.

Another such drawing tube carrier is manufactured by Chartpak in Leeds, Mass. under the trademark of "Cylopak". This tube carrier is also comprised of two straps which attach to the top and bottom of the tube and a shoulder strap joined to the top and bottom straps. This carrier is formed of a nonelastic material and does not stretch excessively as does the previously mentioned carrier. However, this strap also slips up and down the tube and will therefore not facilitate a secure attachment about the tube nor a locking seal for a slip on end cap. The shoulder strap of this carriers is joined to the top and bottom straps much the same as the previously mentioned carrier and presents the same problems regarding a twisting of the shoulder strap during application. In addition, the carrier is arduous and time consuming to attach tightly or remove from a tube. Excessive end material also dangles from the top and bottom straps of this carrier which appears unrefined and unprofessional.

Neither of the aforementioned tube carriers provide a means of conveniently and easily removing the shoulder strap from the carrier while attached to a tube. Nor do they provide a means of preventing the shoulder strap from slipping off the shoulder of the user which can be quite annoying and troublesome. In addition, the aforementioned tube carriers do not provide a means of conveniently and easily attaching more than one tube simultaneously to a single shoulder strap.

Nor are the tube carriers easily adapted to be used in a harness fashion by conveniently attaching an additional shoulder strap and slipping the carrier over the shoulders. Most users, therefore, would find it desirable to have a new and improved carrier which would facilitate the transport of cylindrical objects more proficiently and practically.

OBJECTS AND ADVANTAGES

In view of the aforementioned problems, it is an object of the present invention to provide a new and improved carrier for drawing tubes and other cylindrical objects with slip on end caps not having integrally attached carrying straps.

It is another object of the present invention to provide a new and improved carrier for drawing tubes and other cylindrical objects with slip on end caps not having integrally attached carrying straps which will provide a positive grip and secure attachment to the tube.

It is another object of the present invention to provide a new and improved carrier for drawing tubes and other cylindrical object with slip on end caps not having integrally attached carrying straps which will effectuate a locking seal for slip on end caps of articulated drawing tubes to prevent spilling of the tube contents should the tube be inverted.

It is still another object of the present invention to provide a new and improved carrier for drawing tubes and other cylindrical objects with slip on end caps not having integrally attached carrying straps which can be easily and quickly attached to and removed from the cylinder, and which is adapted to be carried by hand, over one shoulder, or in harness fashion over both shoulders.

It is yet another object of the present invention to provide a new and improved carrier for drawing tubes and other cylindrical objects with slip on end caps not having integrally attached carrying straps which comprises a shoulder and/or hand strap adapted to prevent twisting and slipping off the shoulder of the user.

It is a further object of the present invention to provide a new and improved carrier for drawing tubes and other cylindrical objects with slip on end caps not having integrally attached carrying straps adapted to facilitate the simultaneous attachment of multiple cylindrical objects.

Further objects and advantages will become apparent from a consideration of the drawings and ensuing description of the present invention.

DRAWING REFERENCE NUMERALS

Figure 2:
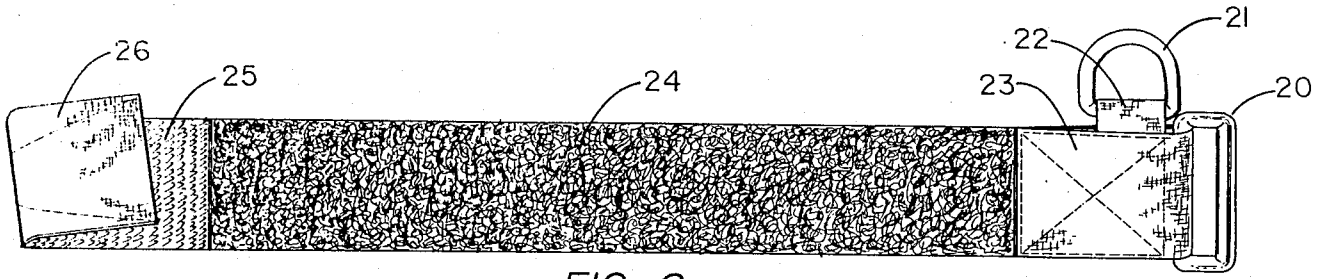
FIG. 2 is a top plan view of a circumferential fastening member.

10 top circumferential strap
11 bottom circumferential fastening member
12 longitudinal carrying fastening member
12*a* duplicate of 12
20 rectangular ring
21 dee ring
22 webbing attaching 21 to 23
23 primary strap of 10 and 11
24 loop fastening material on 23
25 hook fastening material on 23
26 elastomer coating on 23
30 snaphook
31 swivel of 30
32 webbing material of 12
33 shoulder pad on 12
34 slide on 12
40 cylindrical object
41 slip on end cap
42 joint of 40 and 41

DESCRIPTION OF THE INVENTION

A preferred embodiment which has been selected to illustrate the invention, hereinafter referred to as carrier, is formed predominantly of polypropylene webbing or some other strong, flexible, elongate material.

Figure 1:
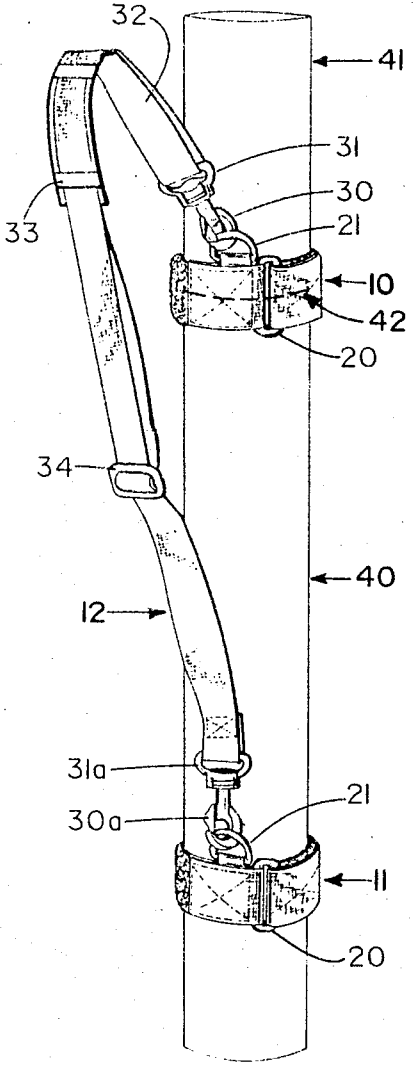
FIG. 1 is a perspective view of the carrier attached to a cylindrical tube; the top circumferential fastening member cinched over and about the joint of the tube and end cap; the bottom circumferential fastening member cinched about the lower region of the tube.

Referring now to FIG. 1, the carrier consists of three major components; a top circumferential fastening member 10, a bottom circuferential fastening 9 member 11 which is identical to the top circumferential fastening member, and a longitudinal carrying strap 12 to function as a shoulder and/or hand strap which is transversely attached to the top and bottom circumferential fastening member.

Referring to FIG. 2 for a description of the preferred embodiment of the preferably identical top and bottom circumferential fastening members 10 and 11; a strong, flexible primary strap 23, preferably of nylon or polypropylene webbing, of adequate length to encircle cylinders of different diameters is introduced under and upward through a preferably rectangular metal or plastic ring 20. The primary strap is then attached to said ring 20 by folding a short length of the primary strap over the side of the ring and securing it by stitching, chemical bonding, or some other suitable technique.

Adjoining the selvage of the primary strap at the rectangular ring attachment is a strip of material consisting of a multiplicity of small loop shaped filamentary fibers 24 which is secured to said primary strap by stitching or some other suitable technique. Adjacent said loop material is a strip of mutually interengageable material complimentary to said loop material consisting of a multiplicity of small filamentary hook shaped fibers 25 extending to the end of the circumferential fastening member opposite the rectangular ring and is securely attached to said primary strap by stitching or some other suitable technique. A short length of the end of the primary strap 23 which is opposite the rectangular ring 20 is preferably folded over and tacked under the attached hook material 25 to prevent fraying of the ends.

In the preferred embodiment, the primary strap of the top and bottom circumferential fastening members, has an elastomer coating 26, preferably a cold applied modified thermoplastic, on the surface opposite the hook and loop material and apposed to the article to be carried to facilitate a nonslip positive grip which will effectuate a locking seal as a result of the nonslip elastomer grippingly adjoining the slip on end cap to the cylindrical object in conjunction with the cinching adaptation of the circumferential fastening member to securely seal the slip on end cap on drawing tubes to prevent the cap from sliding off should the tube be inverted.

Figure 3:
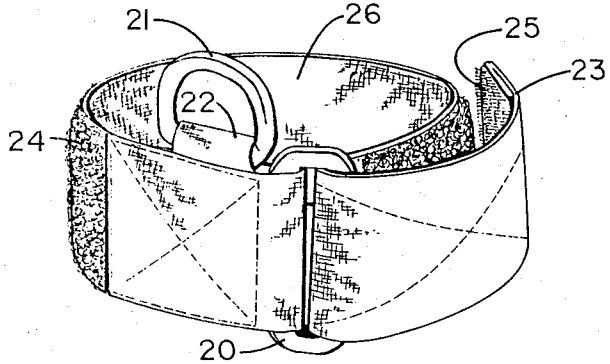
FIG. 3 is a perspective view of a circumferential fastening member as it would be cinched about a cylindrical object.

Completing the preferred embodiment of the identical circumferential fastening members 10 and 11, a metal or plastic ring 21, preferably dee shaped, is attached adjacent the rectangular ring 20 by looping a length of strong, thin, narrow material 22, preferably of nylon or polypropylene webbing, over the base of said ring 21 and securing the narrow material under the fold of the primary strap overlapping the rectangular ring 20. Referring to FIG. 1, a length of elongate, flexible material 32 to function as a shoulder or hand carrying strap, adjustable in length, is connected to the dee ring 21 of top circumferential fastening member 10 by means of a fastener 30. In the preferred embodiment, the fastener is a metal or plastic snaphook, having an aperture of sufficient size to receive and engage more than one dee ring as in FIG. 4. The snaphook preferably comprises a swivel attachment 31 whereby the attached carrying strap is free to rotate about the snaphook to prevent twisting of the carrying strap. The elongate material 32 is attached to said swivel by introducing a short length of said material under, up and over the end of said swivel and is secured by stitching or some other suitable technique. The opposite free end of the elongate material is then extended through a slide 34 to and through the swivel 31*a* of fastener 30*a* which is hooked to the dee ring 21 of bottom circumferential fastening member 11. The end of the elongate material is then attached to said slide 34 by folding a short length of said material around the center bar of said slide and secured by stitching or some other suitable technique completing what shall be hereinafter referred to as longitudinal carrying strap. In the preferred embodiment, an elastomeric shoulder pad 33 adapted to slide longitudinally along the longitudinal carrying strap is placed on the longitudinal strap to distribute the weight of the object over a broader area of the shoulder when in use, and to prevent the strap from slipping off the shoulder of the user. Operation of Invention Referring next to FIGS. 1 and 3 to assemble the carrier to a cylindrical object, top circumferential fastening member 10 is wrapped over and about the joint 42 of a slip on end cap 41 and a cylindrical object 40, and the bottom circumferential fastening member 11 is wrapped around the lower region of the cylindrical object 40, the circumferential straps 10 and 11 are wrapped around opposite ends of the object with the complimentary hook and loop segments 25 and 24 respectively facing outward and the elastomer coated surface 26 facing the surface of the object. The rectangular ring 20 is held stationary while the opposite end of the circumferential fastening member is introduced through the ring 20 and folded back and cinched tightly. The filamentary hook material now confronting the complimentary filamentary loop material is pressed firmly together to form a secure attachment that strongly resists longitudinal movement to hold the circumferential fastening member in a cinched position about the cylindrical object. The hook and loop surfaces may be readily separated by peeling apart. The elastomer coating 26 on the inside of the circumferential fastening members facilitates a positive grip to firmly resist upward or downward slippage and to frictionally lock and seal the slip on end cap 41 on the cylindrical object 40. By tightly cinching the top circumferential fastening member 10 over and about the joint 42 of the slip on end cap 41 of a drawing tube, the tightly cinched circumferential fastening member 10 with its adherent elastomer coating 26 will grippingly adjoin the slip on end cap to the tube to effectuate a locking seal to prevent the cap from sliding off should the tube be inverted.

Figure 5:
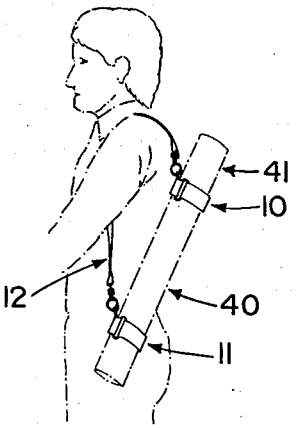
FIG. 5 is a perspective view of the carrier attached to a single tube being carried over the shoulder.

The longitudinal carrying strap 12 is connected to the top and bottom circumferential fastening members via the snaphooks 30 and **30*a* and dee ring 21 and may be adjusted to a suitable length by advancing the slide 34 in either direction. The carrier may be used to tote a article by grasping the longitudinal carrying strap in hand, or over the shoulder as in FIG. 5**. Multiple cylinders may be carried simultaneously using a single longitudinal carrying strap by cinching a pair of circumferential fastening members to opposite ends of each cylinder to be carried and attaching their respective dee rings to the appropriate snaphook.

Figure 4:
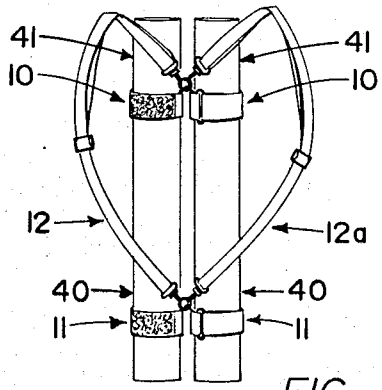
FIG. 4 is a perspective view showing how single or plural tubes can be carried in a harness fashion.

Single or plural tubes may be carried in harness fashion by attaching an additional longitudinal carrying strap **12*a* as depicted in FIG. 4**. By carrying a cylinder or cylinders in said harness fashion, the cylinders hang vertically down the back of the user. Such fashion frees both hands of the user and eliminates any concern that the carrier will slip off the shoulder. Also, the weight of the load is more broadly distributed over both shoulders of the user.

I claim:

1. A carrier and locking seal for articulated drawing tubes and other cylindrical objects with slip on end caps, comprising:

a top circumferential fastening member, a bottom circumferential fastening member, and a longitudinal carrying strap;

said longitudinal carrying strap being formed of flexible, elongate material;

said top and bottom circumferential fastening members comprising:

a primary strap formed of flexible, elongate material having an inner face and an outer face, said inner face being apposed the surface of a cylindrical object when said top and bottom circumferential fastening members are wrapped around said cylindrical object;

a first ring attached to one free end of said primary strap to receive the opposite free end therethrough, and cinching means for facing said top and bottom circumferential fastening members over and about a joint of said cylindrical object and said slip on end cap, and about a lower region of said cylindrical object, respectively;

said outer face of said primary strap comprising a segment having a multiplicity of hook shaped filamentary fibers, and adjacent thereto, a segment having a multiplicity of loop shaped filamentary fibers releasably interengageable with said hook shaped filamentary fibers, said hook and loop shaped filamentary fibers being juxtaposed when said top and bottom circumferential fastening members are cinched about said cylindrical object whereby said top and bottom circumferential fastening members can be held in a cinched position;

sealing means adjoined to said inner face for frictionally sealing and locking, in conjunction with said cinching means, said slip on end cap on said cylindrical object by tightly cinching said top circumferential fastening member over and about said joint so that said sealing means grippingly adheres to said slip on end cap and said cylindrical object adjacent said joint to secure said slip on end cap on said cylindrical object;

a second ring attached adjacent said first ring, and coupling means for transversely connecting said top and bottom circumferential fastening members to opposite ends of said longitudinal carrying strap.

2. The carrier and locking seal for articulated drawing tubes and other cylindrical objects with slip on end caps of claim 1, wherein said sealing means comprises a cold applied modified thermoplastic elastomer coating.

* * * * *